US007536286B2

(12) United States Patent
Nielson et al.

(10) Patent No.: US 7,536,286 B2
(45) Date of Patent: May 19, 2009

(54) METHOD, PROCESS AND COMPUTER PROGRAM TO AUTOMATICALLY CREATE A CUSTOMIZED THREE-DIMENSIONAL NAIL OBJECT

(75) Inventors: Scott L Nielson, Layton, UT (US); Craig P Gifford, West Jordan, UT (US)

(73) Assignee: American Equities Management, LLC, South Lake, TX (US)

( * ) Notice: Subject to any disclaimer, the term of this patent is extended or adjusted under 35 U.S.C. 154(b) by 182 days.

(21) Appl. No.: 10/710,959

(22) Filed: Aug. 14, 2004

(65) Prior Publication Data

US 2006/0036414 A1 Feb. 16, 2006

(51) Int. Cl.
*G06G 7/48* (2006.01)

(52) U.S. Cl. ..... 703/6; 703/1; 382/154; 700/117

(58) Field of Classification Search ..... 703/2, 703/6, 1; 424/61; 264/248; 382/154; 700/117, 700/161

See application file for complete search history.

(56) References Cited

U.S. PATENT DOCUMENTS

| | | | | |
|---|---|---|---|---|
| 2004/0143359 | A1 * | 7/2004 | Yogo et al. | 700/161 |
| 2006/0033758 | A1 * | 2/2006 | Nielson et al. | 345/646 |
| 2006/0034507 | A1 * | 2/2006 | Nielson et al. | 382/154 |

OTHER PUBLICATIONS

Wu et al., J.Z. A Structural Fingertip Model for Simulating of the Biomechanics of Tactile Sensation, Medical Engineering & Physics, vol. 26, No. 2, Mar. 2004, pp. 165-175.*

* cited by examiner

*Primary Examiner*—Russell Frejd
(74) *Attorney, Agent, or Firm*—Clayton, Howarth & Cannon, P.C.

(57) ABSTRACT

The invention is a method, process and computer program to automatically create a customized three-dimensional artificial nail object based upon an actual/existing digitized nail surface. This particular invention generates the overall desired three-dimensional nail surface by using key reference points contained in the digitized nail surface to automatically create new three-dimensional data along supplied parameters. The application of the invention results in a wide scope of possible implementations including a use for creating artificial fingernails and artificial toe-nails.

39 Claims, 6 Drawing Sheets

METHOD, PROCESS AND COMPUTER PROGRAM TO AUTOMATICALLY CREATE A CUSTOMIZED THREE-DIMENSIONAL NAIL OBJECT

CROSS REFERENCE TO RELATED APPLICATIONS

This application references U.S. patent application Ser. No. 10/708,065, filed Feb. 6, 2004.

BACKGROUND OF INVENTION

While working with fingernails and fingernail objects for several years, there was no easy way to automatically create a three-dimensional model of an artificial fingernail object. In fact, most software in the market allows a user to manually manipulate and create just about any three-dimensional object conceivable, but the process of doing this manually is very time consuming and allows for too much human error when creating artificial fingernails with a consistent and reliable appearance. Because of this the inventors set out to find a method to create artificial fingernail objects automatically and this invention was the result. Through careful analysis and study, the key reference points outlined in the Claims section show how to focus a computer software modeling program on a few critical points and then with the help of some supplied parameters relating to expected lengths, widths, heights and curves a desired artificial fingernail object will be automatically created. This new desired three-dimensional object has many applications, not the least of which is the ability to physically create the nail object for the individual and supply them with an artificial nail for use as a cosmetic or even prosthesis. The invention can now save time and virtually guarantee consistent looking fingernail objects, all accomplished with relative ease.

SUMMARY OF INVENTION

The invention is a method, process and computer program to automatically create a customized three-dimensional artificial nail object based upon an actual/existing digitized nail surface. This particular invention generates the overall desired three-dimensional nail surface by using key reference points contained in the digitized nail surface to automatically create new three-dimensional data along supplied parameters. The application of the invention results in a wide scope of possible implementations including a use for creating artificial fingernails and artificial toenails.

DETAILED DESCRIPTION

By starting with an existing digitized three-dimensional surface point array of an actual fingernail or toenail, the invention permits the automatic creation of a new customized three-dimensional object that will fit over the actual fingernail or toenail. This is accomplished by evaluating key points of data contained in the digitized array and by correctly interpreting the reference points and combining with the supplied parameters a new three-dimensional object can be generated, which when combined with the existing digitized three-dimensional object, will create a desired artificial nail object.

The key reference points may include all of the points of data contained in the digitized three-dimensional surface array. However, it is more likely that the following key reference points are used to create the top surface: periphery points, the points along the Y-Axis in the middle of the X-Axis, the points located along the X-axis measured at approximately ⅔rds the distance along the Y-axis from the cuticle end of the nail surface. These reference points are then combined with supplied parameters which may be either constants or changed at the time the desired nail object is generated. The supplied parameters include curves, length, widths and heights. The supplied parameters work with the key reference points to create an expected and desired new three-dimensional object that will fit over the actual fingernail or toenail.

Figure 1:
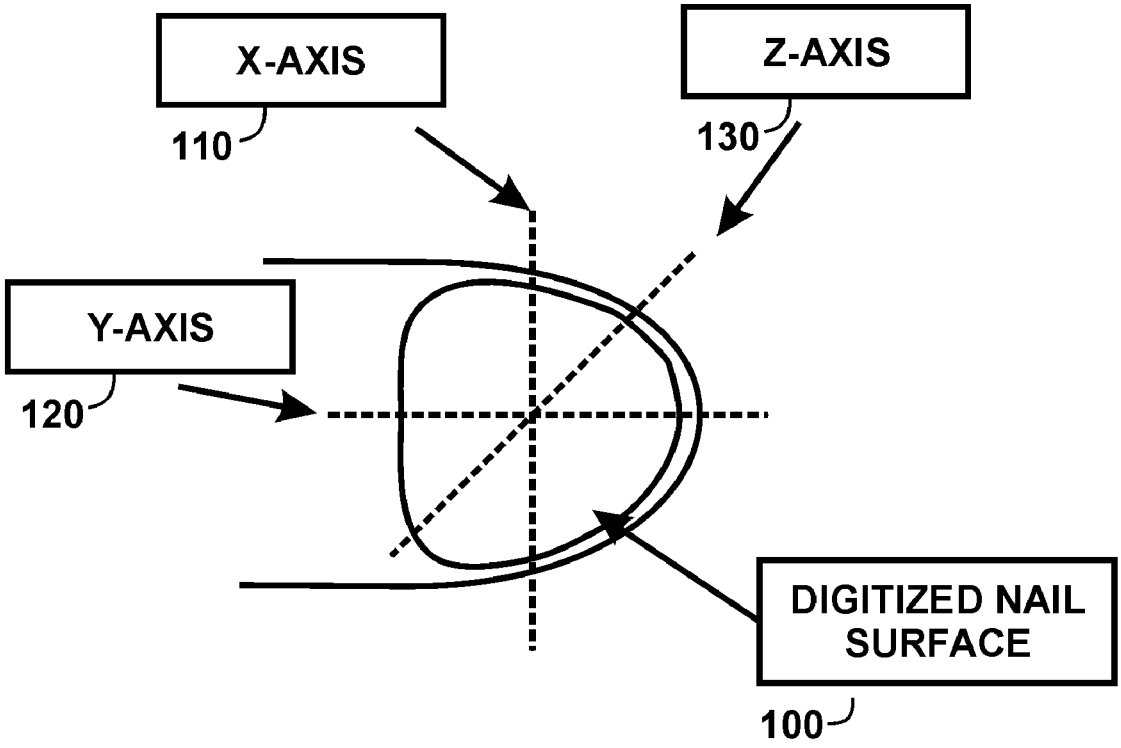
FIG. 1 is a diagram demonstrating the Axis and digitizing of the nail surface object.

In FIG. 1 the first step of the process is demonstrated, where a digitized nail surface 100 is shown and the orientation of the X, Y and Z Axis is established. Here the X-axis 110 is found along the width of the digitized nail surface 100; the Y-axis 120 is the length of the digitized nail surface 100 and can be determined initially by measuring from the cuticle to the tip of the digitized nail surface 100; and the Z-axis 130 represents the height or depth of the digitized nail surface 100. Orienting the three-dimensional data is necessary in order to measure the digitized nail surface 100 and determine the key reference points which are used in conjunction with the supplied parameters to create new three-dimensional data representing the top surface of the final three-dimensional nail object.

Measuring the digitized surface area includes creating a relationship of the X-axis 110, Y-axis 120 and Z-axis 130 to millimeters or inches, further arcs and curves of the digitized nail surface 100 are determined by measuring and creating relationships between the three-dimensional points of data along the X-axis 110, Y-axis 120 and Z-axis 130. These curves and arcs are utilized and manipulated in creating the top surface and eventual desired three-dimensional artificial nail object.

Figure 2:
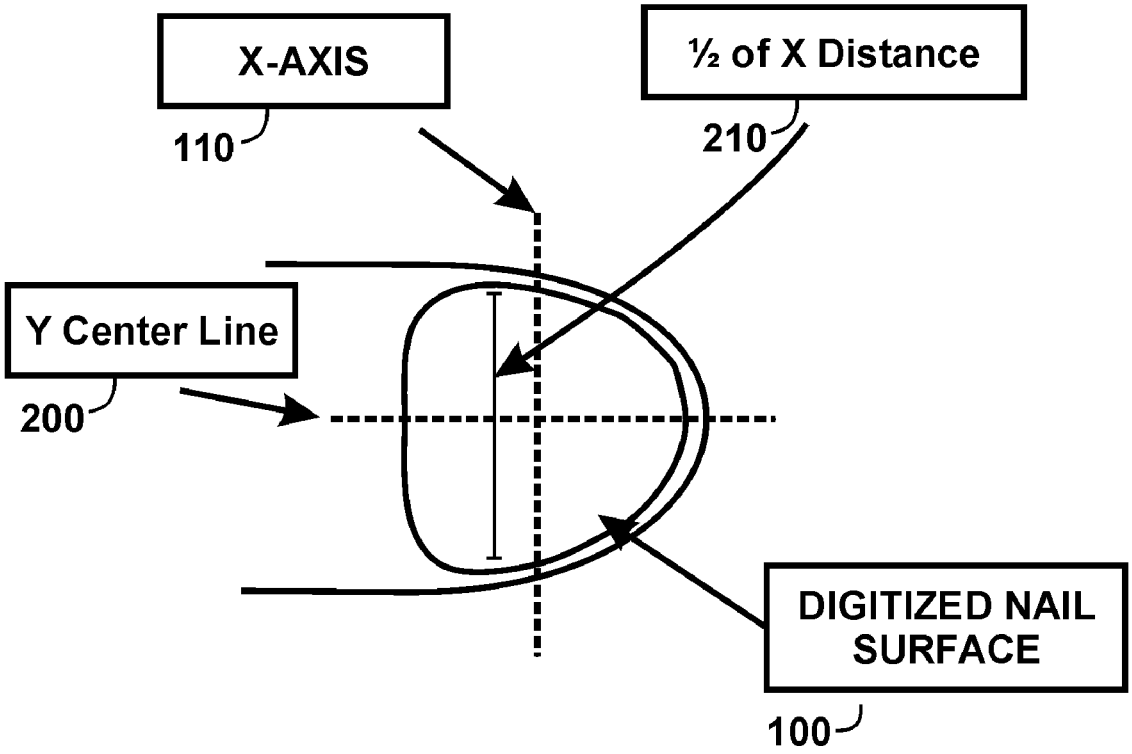
FIG. 2 is a diagram of the step to determine the Y-Center line as ½ of the X-Axis.

FIG. 2 demonstrates the determination of the points along the Y-Center line 200 by taking the sum of points along the greatest X-axis 110 and dividing that by 2 to end up with a midpoint within the X-axis 110. This centerline reference is then utilized to find the center of the digitized nail surface 100 and all of the points along that axis in the Y plane are then utilized to help determine the arc, curve and position of the Generated Nail Surface 500.

Figure 3:
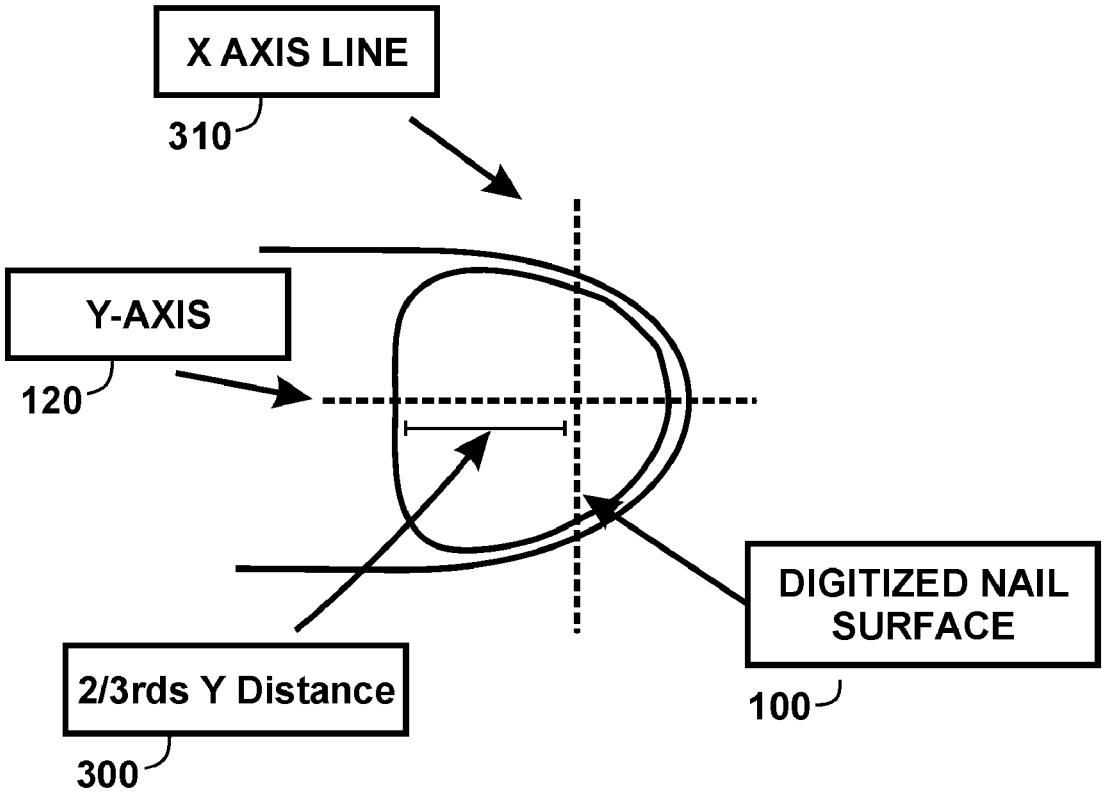
FIG. 3 is a diagram of the X-Line as ⅔rds of the Y-Axis from measuring from the cuticle.
Figure 4:
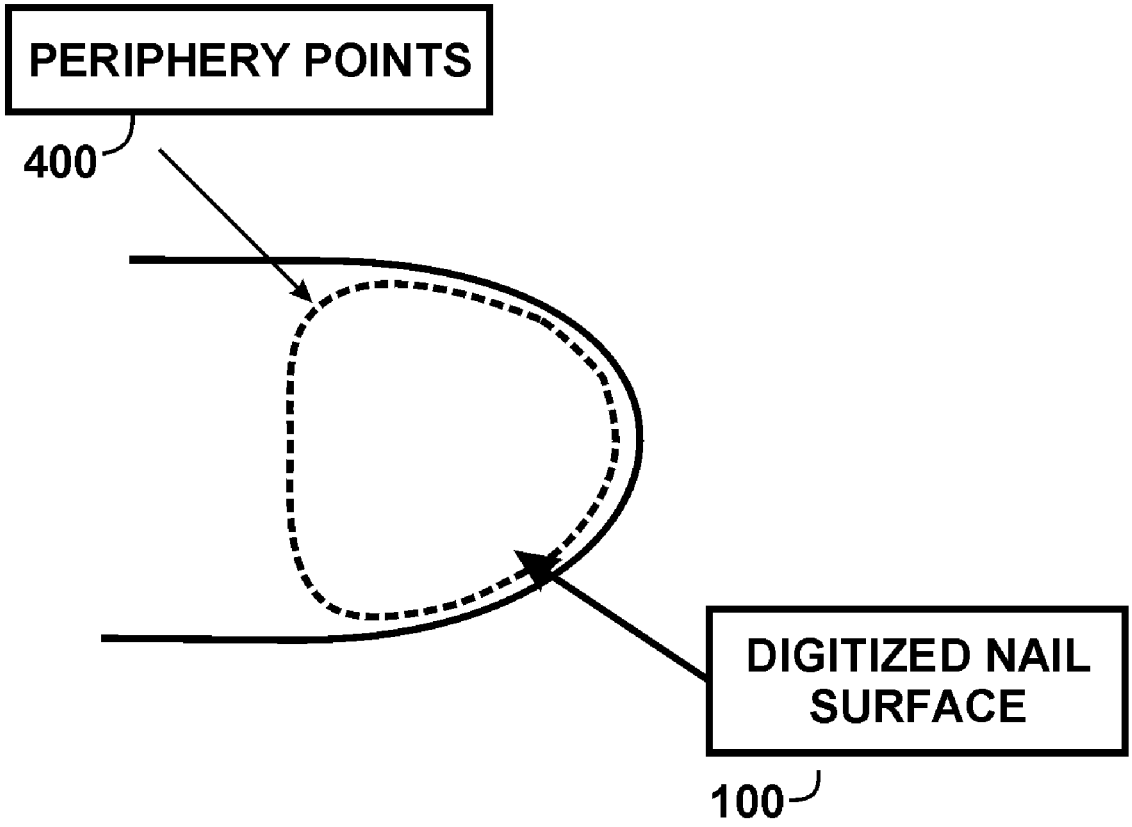
FIG. 4 is a diagram of the periphery points.

FIG. 3 shows another key reference point being determined by taking ⅔rds of the distance of the greatest Y-axis 120 from tip to cuticle. Once that reference point is determined then all of the X-axis 110 points are utilized to help determine arc, curve and position of the Generated Nail Surface 500. The intersection in this case between the X-axis 110 and Y-axis 120 represents the highest point of the Generated Nail Surface 500, which will be no greater than 25 millimeters from the Digitized nail surface 100.

Once the reference points creating heights, lengths and arcs are determined, then FIG. 3 shows the determination of the periphery points 400. This step is vital to insure that the new Generated Nail Surface 500 will fit over the Digitized nail surface 100. The periphery points 400 are combined with the supplied parameters to determine the top surface of the Generated Nail Object 600.

Figure 5:
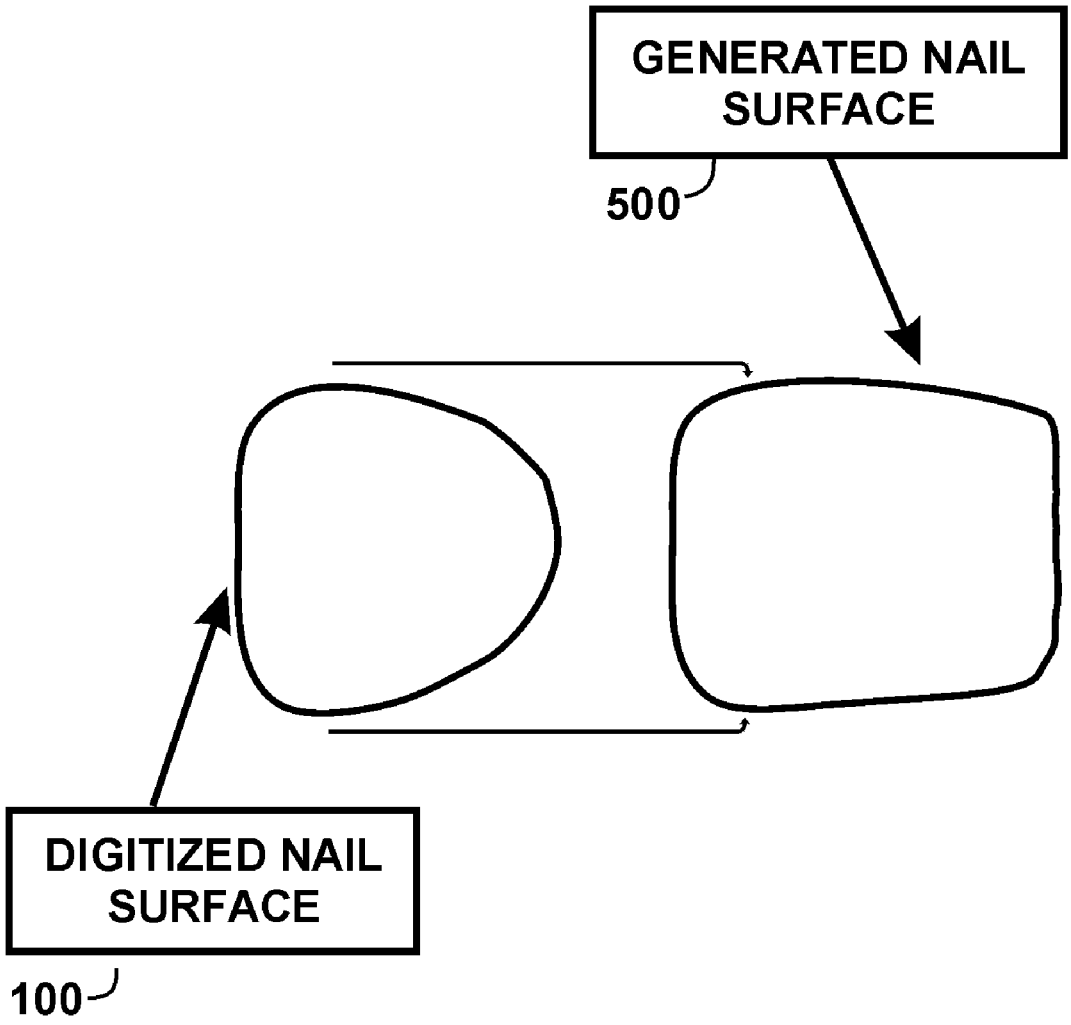
FIG. 5 is a diagram showing the digitized surface used to generate the Top Surface and the combination of the two surfaces to form the desired artificial nail object.

With all the key reference points in mind, FIG. 5 shows the actual new Generated Nail Surface 500 which is a three-dimensional array of data created by the reference points in relationship and combination with supplied parameters indicating the overall desired nail object. The supplied parameters include the desired length, height and width preferences for the desired nail object. The Generated Nail Object 600 combines the top surface calculations with the digitized nail surface 100 to create one consistent and expected artificial nail object. The new nail object will be customized to each particular digitized nail surface 100 and will fit on top of the digitized nail surface 100.

Figure 6:
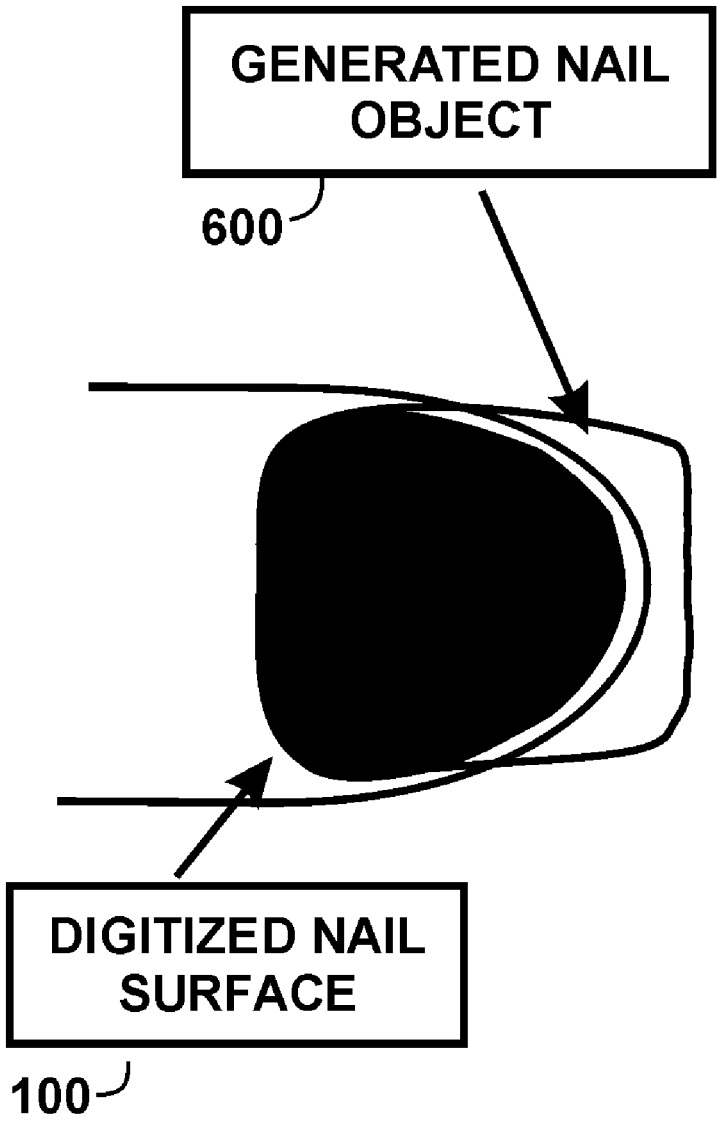
FIG. 6 is a diagram showing the new customized nail object fitting over the digitized surface.

FIG. 6 shows the Generated Nail Surface 500 combined with the Digitized Nail Surface 100 as one Generate Nail Object 600, fitting over the top of the original Digitized Nail Surface 100.

By completing the steps above, virtually any software program or user would be capable of generating a desired and customized three-dimensional artificial nail object. The entire objective of the preferred embodiments of the invention has been to create a simplified method, process and computer program to automatically create a customized three-dimensional nail object. The application of this invention is extensive and plentiful, as with this invention it will become trivial to generate desired three-dimensional artificial nail objects by automation quickly and easily. Because of the advantages inherent in this invention it is anticipated that many variants of this invention are possible, which should be included within the preferred embodiments and descriptions of this invention.

The invention claimed is:

1. A method of creating a three-dimensional nail object, comprising:

receiving, in a processer, a three-dimensional array of data representing a digitized nail surface including receiving data in the form of key reference points on the digitized nail surface along the X-axis, Y-axis and Z-axis;

supplying a set of parameters that define a desired three-dimensional representation of an artificial nail object, in terms of size and shape for the artificial nail object;

manipulating the three-dimensional array of data representing the digitized nail surface along the X-axis, Y-axis and Z-axis to correspond to the size and shape of the artificial nail object;

merging the three-dimensional array of data representing the digitized nail surface with the desired three-dimensional representation of the artificial nail object resulting in a final artificial nail object that conforms to an expected result so that the final nail object will fit over the digitized nail surface and create a desired artificial nail appearance.

2. The method of claim 1, wherein the three-dimensional array of data representing a digitized nail surface includes any data that can be used to represent a three-dimensional object.

3. The method of claim 1, wherein the three-dimensional array of data may be represented as points of data representing an X-axis, Y-axis and Z-axis.

4. The method of claim 1, wherein the method further includes determining a measurement value in millimeters or inches of the nail surface along its X-axis, Y-axis and Z-axis; where X-axis represents width, Y-axis represents the length, and Z-axis represents depth.

5. The method of claim 1, wherein the method further includes determining the arc of the digitized nail surface along the X-axis and/or determining the arc of the nail surface along the Y-axis.

6. The method of claim 1, wherein the method further includes evaluating three-dimensional points along the periphery of the nail surface.

7. The method of claim 1, wherein the key reference points include three-dimensional points along the nail surface at key points comprising points along the Y-axis through the center of the nail surface when viewed along its X-axis, and; points along the X-axis located a approximately ⅔rds the distance from the edge of the cuticle end of the nail surface measured on the Y-axis, said intersection represents the highest point reference of the generated nail object, and;

using all or any substantial portion of three-dimensional points of the nail surface.

8. The method of claim 1, wherein the parameters include constant parameters that are predetermined and include predetermined curves, lengths, widths and heights, which are consistent with the desired object dimensions.

9. The method of claim 1, wherein the parameters include supplying the parameters at the time the object is created and include predetermined curves, lengths, widths and heights, which are consistent with the desired object dimensions.

10. The method of claim 1, wherein manipulating the three-dimensional array of data representing the digitized nail surface includes using the parameters to mathematically create new three-dimensional data that forms the top surface of the desired nail object, where the parameters dictate the top surface data that is generated.

11. The method of claim 1, wherein manipulating the three-dimensional array of data representing the digitized nail surface includes using the parameters to mathematically create new three-dimensional data that forms a nail tip for the desired nail object, and where any potential holes in the three-dimensional data occur are filled during the generation method.

12. The method of claim 1, wherein the desired nail object is achieved by combining the new generated surface as the top surface of the desired nail object and the digitized nail surface forms the bottom surface of the desired nail object wherein the two surfaces are then combined to create the desired nail object.

13. The method of claim of 1, wherein the desired nail object in its final state is a customized three-dimensional object representing an artificial nail that is desired, which fits over the digitized nail surface.

14. A process of creating a three-dimensional nail object, comprising:

receiving, in a processer, a three-dimensional array of data representing a digitized nail surface including receiving data in the form of key reference points on the digitized nail surface along the X-axis, Y-axis and Z-axis;

supplying a set of parameters that define a desired three-dimensional representation of an artificial nail object, in terms of size and shape for the artificial nail object;

manipulating the three-dimensional array of data representing the digitized nail surface along the X-axis, Y-axis and Z-axis to correspond to the size and shape of the artificial nail object;

merging the three-dimensional array of data representing the digitized nail surface with the desired three-dimensional representation of the artificial nail object resulting in a final artificial nail object that conforms to an expected result so that the final nail object will fit over the digitized nail surface and create a desired artificial nail appearance.

15. The process of claim 14, wherein the three-dimensional array of data representing a digitized nail surface includes any data that can be used to represent a three-dimensional object.

16. The process of claim 14, wherein the three-dimensional array of data may be represented as points of data representing an X-axis, Y-axis and Z-axis.

17. The process of claim 14, wherein the process further includes determining a measurement value in millimeters or inches of the nail surface along its X-axis, Y-axis and Z-axis; where X-axis represents width, Y-axis represents the length, and Z-axis represents depth.

18. The process of claim 14, wherein the process further includes determining the arc of the digitized nail surface along the X-axis and/or determining the arc of the nail surface along the Y-axis.

19. The process of claim 14, wherein the process further includes evaluating three-dimensional points along the periphery of the tip of the nail surface.

20. The process of claim 14, wherein key reference points includes three-dimensional points along the nail surface at key points including; points along the Y-axis through the center of the nail surface when viewed along its X-axis, and; points along the X-axis located a approximately ⅔rds the distance from the edge of the cuticle end of the nail surface measured on the Y-axis said intersection represents the highest point reference of the generated nail object, and;

using all or any substantial portion of three-dimensional points of the nail surface.

21. The process of claim 14, wherein the parameters include constant parameters that are predetermined and include predetermined curves, lengths, widths and heights, which are consistent with the desired object dimensions.

22. The process of claim 14, wherein the parameters include supplying the parameters at the time the object is created and include predetermined curves, lengths, widths and heights, which are consistent with the desired object dimensions.

23. The process of claim 14, wherein manipulating the three-dimensional array of data representing the digitized nail surface includes using the parameters to mathematically create new three-dimensional data that forms the top surface of the desired nail object, where the parameters dictate the top surface data that is generated.

24. The process of claim 14, wherein manipulating the three-dimensional array of data representing the digitized nail surface includes using the parameters to mathematically create new three-dimensional data that forms a nail tip for the desired nail object, and where any potential holes in the three-dimensional data occur, they are filled during the generation process.

25. The process of claim 14, wherein the desired nail object is achieved by combining the new generated surface as the top surface of the desired nail object and the digitized nail surface forms the bottom surface of the desired nail object wherein the two surfaces are then combined to create the desired nail object.

26. The process of claim of 14, wherein the desired nail object in its final state is a customized three-dimensional object representing an artificial nail that is desired, which fits over the digitized nail surface.

27. A computer program comprising a set of instructions stored on computer readable memory that are processed by a processor, comprising:

receiving a three-dimensional array of data representing a digitized nail surface including receiving data in the form of key reference points on the digitized nail surface along the X-axis, Y-axis and Z-axis;

supplying a set of parameters that define a desired three-dimensional representation of an artificial nail object, in terms of size and shape for the artificial nail object;

manipulating the three-dimensional array of data representing the digitized nail surface along the X-axis, Y-axis and Z-axis to correspond to the size and shape of the artificial nail object;

merging the three-dimensional array of data representing the digitized nail surface with the desired three-dimensional representation of the artificial nail object resulting in a final artificial nail object that conforms to an expected result so that the final nail object will fit over the digitized nail surface and create a desired artificial nail appearance.

28. The computer program of claim 27, wherein the three-dimensional array of data representing a digitized nail surface includes any data that can be used to represent a three-dimensional object.

29. The computer program of claim 27, wherein the three-dimensional array of data may be represented as points of data representing an X-axis, Y-axis and Z-axis.

30. The computer program of claim 27, wherein the computer program further includes determining a measurement value in millimeters or inches of the nail surface along its X-axis, Y-axis and Z-axis; where X-axis represents width, Y-axis represents the length, and Z-axis represents depth.

31. The computer program of claim 27, wherein the computer program further includes determining the arc of the digitized nail surface along the X-axis and/or determining the arc of the nail surface along the Y-axis.

32. The computer program of claim 27, wherein the computer program further includes evaluating three-dimensional points along the periphery of the tip of the nail surface.

33. The computer program of claim 27, wherein key reference points includes three-dimensional points along the nail surface at key points including; points along the Y-axis through the center of the nail surface when viewed along its X-axis, and; points along the X-axis located a approximately ⅔rds the distance from the edge of the cuticle end of the nail surface measured on the Y-axis said intersection represents the highest point reference of the generated nail object, and; using all or any substantial portion of three-dimensional points of the nail surface.

34. The computer program of claim 27, wherein the parameters includes constant parameters that are predetermined and include predetermined curves, lengths, widths and heights, which are consistent with the desired object dimensions.

35. The computer program of claim 27, wherein the parameters include supplying the parameters at the time the object is created and include predetermined curves, lengths, widths and heights, which are consistent with the desired object dimensions.

36. The computer program of claim 27, wherein manipulating the three-dimensional array of data representing the digitized nail surface includes using the parameters to mathematically create new three-dimensional data that forms the top surface of the desired nail object, where the parameters dictate the top surface data that is generated.

37. The computer program of claim 27, wherein manipulating the three-dimensional array of data representing the digitized nail surface includes using the parameters to mathematically create new three-dimensional data that forms a nail tip for the desired nail object, and where any potential holes in the three-dimensional data occur, they are filled during the generation computer program.

38. The computer program of claim 27, wherein the desired nail object is achieved by combining the new generated surface as the top surface of the desired nail object and the digitized nail surface forms the bottom surface of the desired nail object wherein the two surfaces are then combined to create the desired nail object.

39. The computer program of claim of 27, wherein the desired nail object in its final state is a customized three-dimensional object representing an artificial nail that is desired, which fits over the digitized nail surface.

* * * * *